US008256443B2

(12) United States Patent
Neal

(10) Patent No.: US 8,256,443 B2
(45) Date of Patent: Sep. 4, 2012

(54) COLLAPSIBLE PRIVACY SHELTER

(76) Inventor: Dan Neal, Lenexa, KS (US)

( * ) Notice: Subject to any disclaimer, the term of this patent is extended or adjusted under 35 U.S.C. 154(b) by 80 days.

(21) Appl. No.: 12/786,924

(22) Filed: May 25, 2010

(65) Prior Publication Data

US 2011/0290291 A1 Dec. 1, 2011

(51) Int. Cl.
*E04H 15/02* (2006.01)

(52) U.S. Cl. ..... 135/96

(58) Field of Classification Search ..... 135/96, 135/97; 52/79.5; 312/258, 262
See application file for complete search history.

(56) References Cited

U.S. PATENT DOCUMENTS

| | | | | | |
|---|---|---|---|---|---|
| 2,934,389 | A * | 4/1960 | Krey | 312/262 |
| 3,017,194 | A * | 1/1962 | Anderson | 280/18 |
| 3,294,464 | A * | 12/1966 | Lew | 312/258 |
| 3,854,746 | A * | 12/1974 | Flynn et al. | 280/19.1 |
| 4,523,418 | A * | 6/1985 | McLaughlin | 52/284 |
| 4,870,984 | A * | 10/1989 | Roth | 135/148 |
| 5,323,921 | A * | 6/1994 | Olsson | 217/12 R |
| 5,474,230 | A * | 12/1995 | Yotukura | 229/117.04 |
| 5,975,660 | A * | 11/1999 | Tisbo et al. | 312/263 |
| 6,244,443 | B1 * | 6/2001 | Nickell et al. | 206/600 |
| 6,250,022 | B1 * | 6/2001 | Paz et al. | 52/79.5 |
| 6,722,750 | B2 * | 4/2004 | Chan | 312/258 |
| 6,848,758 | B1 * | 2/2005 | Yeh et al. | 312/258 |
| 6,948,280 | B2 * | 9/2005 | Marcinkowski et al. | 52/79.1 |
| 6,948,787 | B2 * | 9/2005 | McBrayer et al. | 312/258 |
| 7,743,781 | B2 * | 6/2010 | Slaughter | 135/117 |
| 8,042,698 | B2 * | 10/2011 | Kim et al. | 211/78 |
| 2009/0014044 | A1 * | 1/2009 | Hartman et al. | 135/143 |

* cited by examiner

*Primary Examiner* — Noah Chandler Hawk

(57) ABSTRACT

A collapsible privacy shelter includes an upper section, lower section, and roof section. The lower section includes a back wall, a pair of side walls pivotally connected to the back wall of the lower section and are operable to fold inward, a front wall pivotally connected to the plurality of side walls of the lower section, and a door pivotally connected to the front wall of the lower section. The upper section includes a back wall disposed on an edge of the back wall of the lower section and operable to engage the back wall of the lower section, a pair of opposing side walls pivotally connected to the back wall of the upper section and operable to fold inward and each operable to engage a corresponding side wall of the lower section, a front wall pivotally connected to the plurality of side walls of the upper section and operable to engage the front wall of the lower section, and a door pivotally connected to the upstanding front wall of the upper section and operable to engage the door of the lower section. The roof section includes a roof operable to engage an upper portion of the upper section.

13 Claims, 17 Drawing Sheets

COLLAPSIBLE PRIVACY SHELTER

FIELD OF THE INVENTION

The present invention relates to privacy shelters. More particularly, the invention relates to portable collapsible privacy shelters.

BACKGROUND

People often spend hours cooking, drinking, and socializing outside arenas and stadiums before sporting events, rock concerts, or other events at so-called tailgate parties. Frequently, the attendees will need to use a toilet but, due to distance from the party site, poor sanitation of the facilities, or other reasons, attendees are often dissuaded from doing so. Additionally, at events in the fall or spring, changing outdoor temperatures may cause some attendees to wish to change their clothes to lighter or heavier clothing, depending on the circumstances. Attendees generally will not change their clothes in public, and public toilets are frequently not used due for changing clothes due to their cleanliness. Some try to change clothes in a car or other motor vehicle, but the windows of the vehicle undermine attempts at modesty and the seats and low roof of vehicles prevent attempts to stand and dress. Additionally, some have attempted to use upstanding tent-like shelters for tailgating but, especially in windy conditions, their efficacy is limited. Various other forms of privacy shelters have been developed, but they all have limitations that make them unsuitable for some applications.

SUMMARY

The present invention solves the above-described problems and provides a distinct advance in the art of privacy shelters. More particularly, the present invention provides a privacy shelter that is portable, collapsible, easy to transport, assemble and disassemble, and will not tip in windy conditions.

One embodiment of the portable shelter of the present invention broadly includes a lower section, an upper section, a roof section, and a stabilization component. The lower section and the upper section each include a back wall, side walls having inwardly-folding hinges, a front wall, and a door. The upper and lower sections may be folded flat, like an accordion, along their hinged side walls for convenient transport in a trunk, truck bed, or the like, and then extended for assembly. The roof section comprises a frame and a roof. The upper and lower sections may further include shelf members for securing the sidewalls in position, and a plurality of fastening mechanisms for securing the sections together.

In use, the lower section, upper section, and the roof may be transported in a collapsed configuration to an assembly site. There, the lower section and the upper section are each extended. The upper section is placed on the lower section and the shelf members are extended to secure the upper section and the lower section in an extended configuration. The lower section is removably attached to the upper section with the fastening mechanisms and, likewise, the upper section is attached to the roof with a plurality of fastening mechanisms. After use, the shelter may be quickly and easily disassembled by reversing the above steps.

In another embodiment, the inwardly-folding hinges of the side walls of the upper and lower sections and the hinges between each door and each front wall of the upper and lower sections of the privacy shelter may use inwardly-folding living hinges. Additionally, hinges between adjacent walls may use continuous hinges.

In another embodiment, the back wall, side walls, and door of the upper and lower sections further include removable panels that may be customized with logos, advertisements, mascots, or the like. In some embodiments, the removable panels are display screens that are operable to display static, rotating, or moving images.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
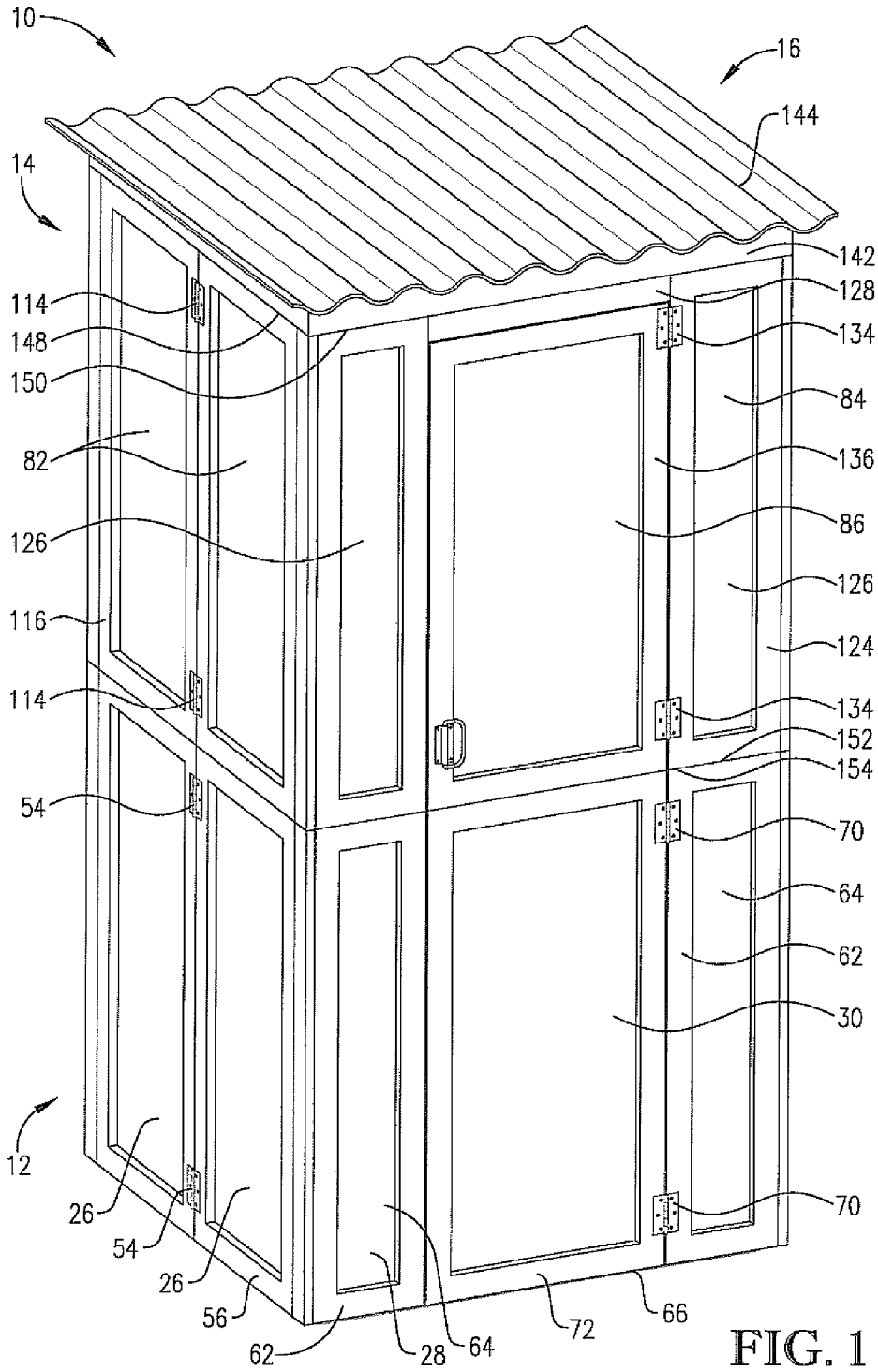
FIG. 1 is a front side isometric view of a privacy shelter constructed in accordance with embodiments of the present invention.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Figure 2:
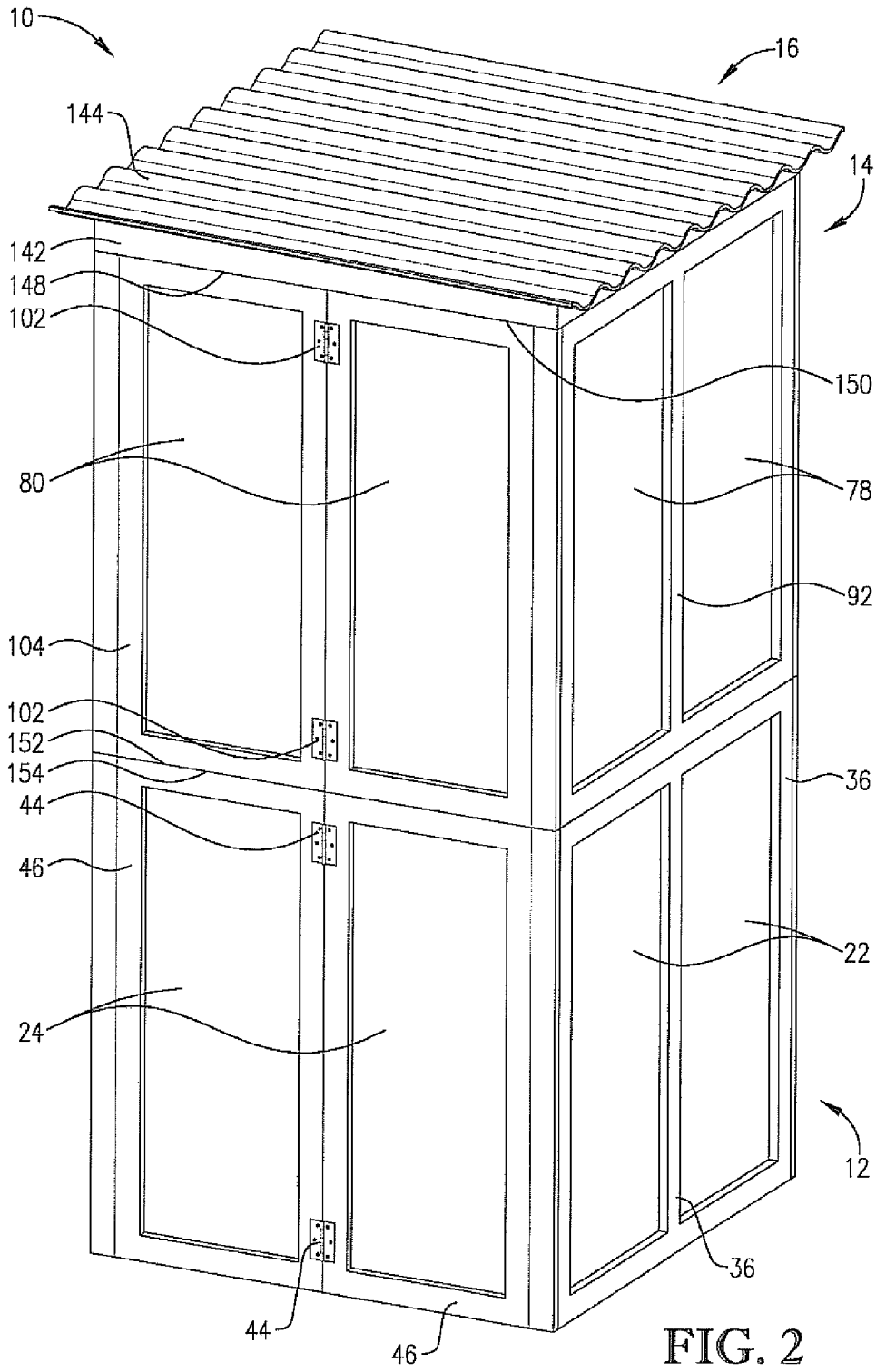
FIG. 2 is a rear side isometric view of the privacy shelter.
Figure 3:
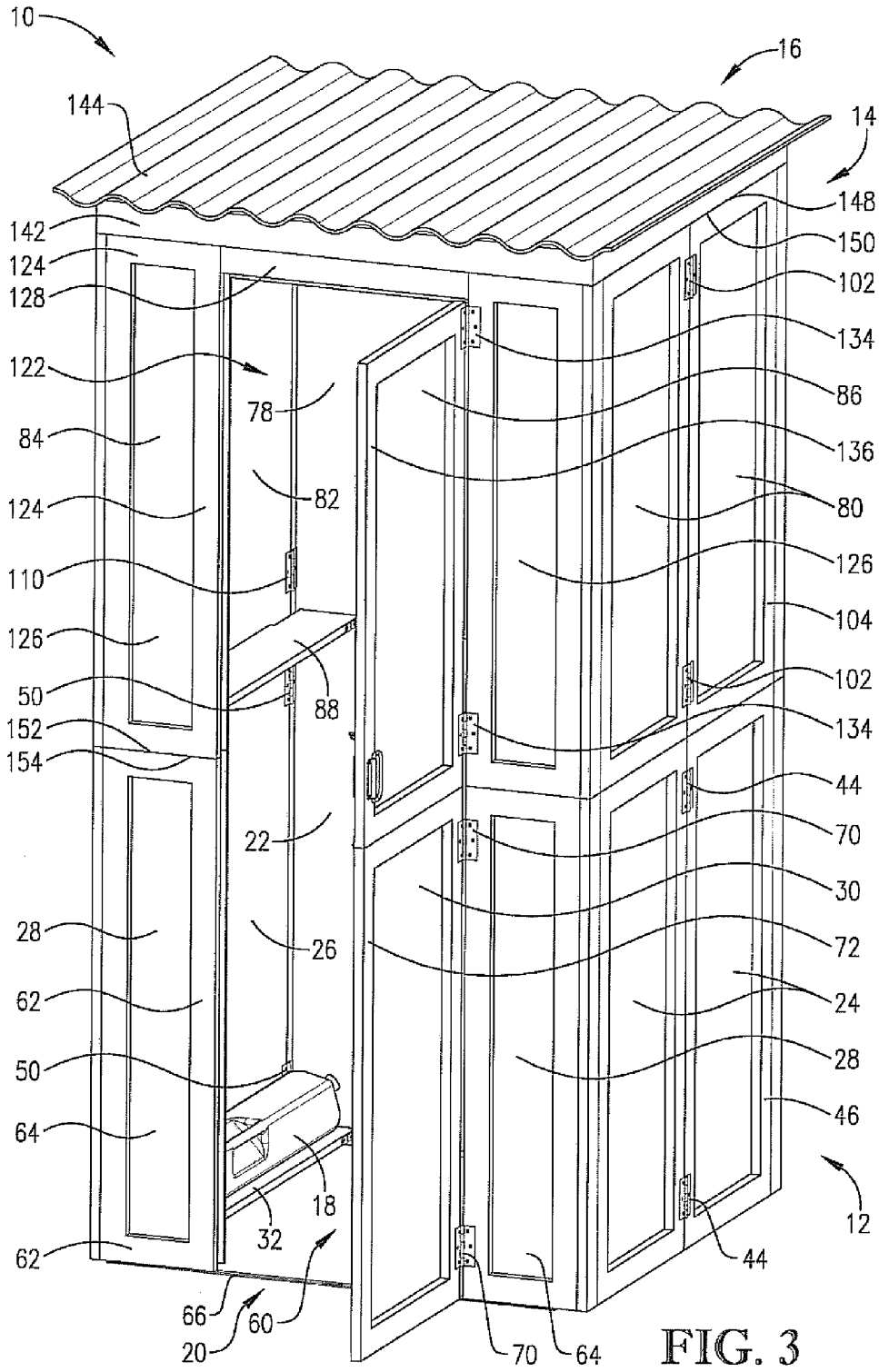
FIG. 3 is front side isometric view of the privacy shelter showing the door open to partially show interior portions of the privacy shelter.

Turning now to the drawing figures, and initially FIGS. 1-3, a privacy shelter 10 constructed in accordance with an embodiment of the invention is illustrated. The privacy shelter 10 broadly includes a lower section 12, an upper section 14, a roof section 16, and a stabilization component 18 that collectively define an interior space 20.

The lower section 12 includes a back wall 22, a right side wall 24, a left side wall 26, a front wall 28, a door 30, a shelf member 32, and a plurality of fastening mechanisms 34.

The back wall 22 is generally-planar and may be constructed of wood, metal, plastic, fiberglass, or the like. In some embodiments, the back wall 22 may include various reinforcing elements 36 to strengthen it. In some embodiments, the back wall 22 may include a flange 38 or other element along an upper edge for receiving or mating with the upper section 14.

The right side wall 24 is also generally-planar and may be constructed of wood, metal, plastic, fiberglass, PVC, or the like. The right side wall 24 is pivotally connected at its lateral ends to the back wall 22 and front wall 28 with hinges 40, 42. The right side wall 24 further includes an interior hinge 44 along a generally-vertical central axis so the right side wall 24 may fold inward, like an accordion, as described in more detail below. In some embodiments, the right side wall 24 may include various reinforcing elements 46 to strengthen it. The hinges 40, 42 may be barrel hinges, pivot hinges, continuous hinges, concealed hinges, or the like. In some embodiments, the right side wall 24 may include a flange 48 or other element along an upper edge for receiving or mating with the upper section 14.

The left side wall 26 is also generally-planar and may be constructed of wood, metal, plastic, fiberglass, PVC, or the like. The left side wall 26 is pivotally connected at its lateral ends to the back wall 22 and front wall 28 with hinges 50, 52. The left side wall 26 further includes an interior hinge 54 along a generally-vertical central axis so the left side wall 26 may fold inward, like an accordion, as described in more detail below. In some embodiments, the left side wall 26 may include various reinforcing elements 56 to strengthen it. The hinges 50, 52 may be barrel hinges, pivot hinges, continuous hinges, concealed hinges, or the like. In some embodiments, the left side wall 26 may include a flange 58 or other element along an upper edge for receiving or mating with the upper section 14.

The front wall 28 is also generally-planar and may be constructed of wood, metal, plastic, fiberglass, PVC, or the like. The front wall 28 is pivotally connected at its lateral ends to the right side wall 24 and left side wall 26 with hinges 42, 52. The front wall 28 may include an opening 60 for defining an ingress and egress point for the privacy shelter 10 and for receiving the door 30 therein along an edge of the opening 60. In some embodiments, the front wall 28 may include various reinforcing elements 62 to strengthen it. In some other embodiments, the front wall 28 may include several pieces that are assembled to form a unitary whole. For example, the front wall 28 may include two generally rectangular lateral walls 64 and a cross-member 66 attached at a lower end of each lateral wall 64. Thus, in this embodiment, each lateral wall 64 and the cross-member 66 define a generally planar surface with a rectangular opening 60 for receiving the door 30 therein. In some embodiments, the front wall 28 may include a flange 68 or other element along an upper edge for receiving or mating with the upper section 14.

The door 30 is generally planar and may be constructed of wood, metal, plastic, fiberglass, PVC, or the like. The door 30 is pivotally attached with a hinge 70 along a lateral edge to an edge of the front wall 28 along the opening 60 for selectively allowing or preventing ingress and egress through the opening 60 and thereby allowing privacy within the interior space 20 of the privacy shelter 10. Additionally, in some embodiments, the door 30 may include various reinforcing elements 72 to strengthen it. The hinge 70 may be a barrel hinge, pivot hinge, continuous hinge, concealed hinge, or the like. In some embodiments, the door 30 may include a flange 74 or other element along an upper edge for receiving or mating with the upper section 14.

Advantageously, the right side wall 24 and the left side wall 26 are operable to collapse inward along their respective inward-folding hinges 44, 54, like an accordion, so that the front wall 28 and back wall 22 are brought in close proximity. Thus, the lower section 12 is operable to fold relatively flat, along the inward-folding hinges 44, 54 of the right and left side walls 24, 26 for easy transport in a trunk, truck bed, or the like. The lower section 12 can also easily expand by straightening the right and left side walls 24, 26 into an extended position for assembling the privacy shelter 10.

The shelf member 32 is generally planar and rectangular and may be constructed of wood, metal, plastic, fiberglass, PVC, or the like. The shelf member 32 is pivotally-connected to a lower position of the back wall 22 or the front wall 28 with a hinge 76 for securing right side wall 24 or left side wall 26 in an extended position. Some embodiments may include two shelf members 32 for securing both the right side wall 24 and the left side wall 26. The hinge 76 may be a barrel hinge, pivot hinge, continuous hinge, concealed hinge, or the like.

The lower section 12 may include a plurality of fastening mechanisms 34 disposed along the upper edge of the back wall 22, the right side wall 24, the left side wall 26, the front wall 28 and the door 30 for securing the upper section 14 to the lower section 12. Each fastening mechanism 34 may be a latch, hook, cabin hook, other conventional fastener, a mating portion thereof, or the like.

The upper section 14 broadly further includes a back wall 78, a right side wall 80, a left side wall 82, a front wall 84, a door 86, a shelf member 88, and a plurality of fastening mechanisms 90. As explained in more detail below, the components of the upper section generally interact with the back wall 22, the left side wall 24, the right side wall 26, the front wall 28, the door 30, the shelf member 32, and the plurality of fastening mechanisms 34 of the lower section 12.

The back wall 78 is generally-planar and may be constructed of wood, metal, plastic, fiberglass, PVC, or the like. The back wall 78 may include various reinforcing elements 92 to strengthen it. The back wall 78 of the upper section 14 is operable to be removably attached to the back wall 22 of the lower section 12. In some embodiments, the back wall 78 may include a flange 94 or other element along a lower edge for receiving or mating with an upper portion of the back wall 22 of the lower section 12. In some other embodiments, the back wall 78 may further include a flange 96 or other element along an upper edge for receiving or mating with a lower portion of the roof section 16. In some embodiments, an inner surface of the back wall 78 additionally includes a mirror.

The right side wall 80 is generally-planar and may be constructed of wood, metal, plastic, fiberglass, PVC, or the like. The right side wall 80 is pivotally connected at its lateral ends to the back wall 78 and front wall 84 with hinges 98, 100. The right side wall 80 of the upper section 14 is operable to be removably attached to the right side wall 24 of the lower section 12. The right side wall 80 further includes an interior hinge 102 along a generally-vertical central axis so the right side wall 80 may fold inward, like an accordion, as described in more detail below. In some embodiments, the right side wall 80 may include various reinforcing elements 104 to strengthen it. The hinges 98, 100 may be barrel hinges, pivot hinges, continuous hinges, concealed hinges, or the like. In some embodiments, the right side wall 80 may include a flange 106 or other element along a lower edge for receiving or mating with an upper portion of the right side wall 24 of the lower section 12. In some other embodiments, the right side wall 80 may further include a flange 108 or other element along an upper edge for receiving or mating with a lower portion of the roof section 16.

The left side wall 82 is generally-planar and may be constructed of wood, metal, plastic, fiberglass, PVC, or the like. The left side wall 82 is pivotally connected at its lateral ends to the back wall 78 and front wall 84 with hinges 110, 112. The left side wall 82 of the upper section 14 is operable to be removably attached to the left side wall 26 of the lower section 12. The left side wall 82 further includes an interior hinge 114 along a generally-vertical central axis so each side wall may fold inward, like an accordion, as described in more detail below. In some embodiments, the left side wall 82 may include various reinforcing elements 116 to strengthen it. The hinges 110, 112 may be barrel hinges, pivot hinges, continuous hinges, concealed hinges, or the like. In some embodiments, the left side wall 82 may include a flange 118 or other element along a lower edge for receiving or mating with an upper portion of the left side wall 26 of the lower section 12. In some other embodiments, the left side wall 82 may further include a flange 120 or other element along an upper edge for receiving or mating with a lower portion of the roof section 16.

The front wall 84 of the upper section 14 is also generally-planar and may be constructed of wood, metal, plastic, fiberglass, PVC, or the like. The front wall 84 is pivotally connected at its lateral ends to the right side wall 80 and left side wall 82 with a hinge 100, 112. The front wall 68 may include an opening 122 in its interior for defining an ingress and egress point for the privacy shelter 10 and for receiving the door 86 therein. Additionally, in some embodiments, the front wall 84 may include various reinforcing elements 124 to strengthen it. In some other embodiments, the front wall 84 may include several pieces that are assembled to form a unitary whole. For example, the front wall 84 may include two generally rectangular lateral walls 126 and a cross-member 128 attached at an upper end of each lateral wall 126. Thus, in this embodiment, the lateral walls 126 and the cross-member 128 define a generally planar surface and a rectangular opening 122 for receiving the door 86 therein. The front wall 84 of the upper section 14 is operable to be removably attached to the front wall 28 of the lower section 12. In some embodiments, the front wall 84 may include a flange 130 or other element along a lower edge for receiving or mating with an upper portion of the front wall 28 of the lower section 12. In some other embodiments, the front wall 84 may further include a flange 132 or other element along an upper edge for receiving or mating with a lower portion of the roof section 16. In some embodiments, the front wall 84 may be taller than the back wall 78 and the right side wall 80 and left side wall 82 are trapezoidal with parallel vertical sides to provide a slanted and generally continuous upper surface for the roof section 16 when assembled.

The door 86 of the upper section 14 is generally planar and may be constructed of wood, metal, plastic, fiberglass, PVC, or the like. The door 86 is pivotally attached with a hinge 134 along a lateral edge to an edge of the front wall 84 along the opening 122 for selectively allowing or preventing ingress and egress through the opening 122 and thereby allowing privacy within the interior space 20 of the privacy shelter 10. Additionally, in some embodiments, the door 86 may include various reinforcing elements 136 to strengthen it. The hinge 134 may be a barrel hinge, pivot hinge, continuous hinge, concealed hinge, or the like. The door 86 of the upper section 14 is operable to be removably attached to the door 30 of the lower section 12. In some embodiments, the door 86 may include a flange 138 or other element along a lower edge for receiving or mating with an upper portion of the door 30 of the lower section 12.

Advantageously, the right side wall 80 and the left side wall 82 are operable to collapse inward along their respective inward-folding hinges 102, 114, like an accordion, so that the front wall 84 and back wall 78 are brought in close proximity. Thus, the upper section 14 is operable to fold relatively flat, along the inward-folding hinges 102, 114 of the right and left side walls 80, 82 for easy transport in a trunk, truck bed, or the like. The upper section 14 can also easily expand by straightening the right and left side walls 80, 82 into an extended position for assembling the privacy shelter 10.

The shelf member 88 is generally planar and rectangular and may be constructed of wood, metal, plastic, fiberglass, PVC, or the like. The shelf member 88 is pivotally-connected to a lower position of the back wall 78 or the front wall 84 with a hinge 140 for securing the right side wall 80 or left side wall 82 in an extended position. Some embodiments may include two shelf members 88 for securing both the right side wall 80 and the left side wall 82. The hinge 140 may be a barrel hinge, pivot hinge, continuous hinge, concealed hinge, or the like.

The upper section 14 may include a plurality of fastening mechanisms 90 disposed along the lower edge of the back wall 78, the right side wall 80, the left side wall 82, the front wall 84 and the door 86 for securing the upper section 14 to the lower section 12. The upper section 14 may also include the of fastening mechanisms 90 disposed along the upper edge of the back wall 78, the right side wall 80, the left side wall 82, the front wall 84, and the door 86 for securing the upper section 14 to the roof section 16. Each fastening mechanism 90 may be a latch, hook, cabin hook, other conventional fastener, a mating portion thereof, or the like.

The roof section 16 is a sloped member for removably attaching to the upper section 14 and, in some embodiments, includes a frame 142, a roof 144, and fastening mechanism 146.

The frame 142 is a generally rectangular and planar and may be constructed of wood, metal, plastic, fiberglass, PVC, or the like. The lower edge 148 of the frame 142 is operable to receive or mate with an upper edge 150 of the upper section 14. In some embodiments, the upper surface of the frame 142 is sloped so that when the roof 144 is placed thereon it is also sloped to allow precipitation to drip from a lateral or back edge of the roof 144. In some embodiments, the frame 142 may further include a power source, such as a battery or solar panel, and a light disposed on a lower portion for lighting the interior space 20 of the privacy shelter 10.

The roof 144 is a generally rectangular surface for preventing precipitation from entering the privacy shelter and for enclosing the interior space 20 of the privacy shelter 10 and may be fabricated of wood, metal, plastic, fiberglass, PVC, or the like. In some embodiments, the roof 144 is a rectangular piece of plywood with conventional roofing shingles disposed thereon. In other embodiments, the roof 144 includes a corrugated plastic panel. In some other embodiments, the roof 144 is positioned on the frame 142 so that a gap between the roof 144 and the frame 142 enables air to flow into and out of the interior space 20 of the privacy shelter 10. In yet other embodiments, the roof 144 includes a removable panel supported within a groove in an interior edge of the frame 142. In this embodiment, if the roof 144 is slanted, a portion of the frame 142 extending above the upper surface of the removable panel may be eliminated along a lower edge to prevent water from pooling and, thus, causing leaks. In some embodiments, the roof 144 is translucent to allow exterior light to enter the interior space 20 of the privacy shelter 10. In yet other embodiments, the roof 144 may further include a power source, such as a battery or solar panel, and a fan for cooling the interior space 20 of the privacy shelter 10.

The stabilization component 18 is weighted member for improving the stability of the privacy shelter 10 in windy conditions. The stabilization component 18 may be disposed on a shelf member 32 of the lower section 12 to prevent movement or tipping of the structure from outside forces, such as wind or inadvertent contact from people standing outside the privacy shelter 10. In one embodiment, the stabilization component 18 comprises a hollow cylindrical tube that is sealed at a first end and includes a removable cover at a second end for containing water or sand therein. In another embodiment, the stabilization component 18 may be a sandbag. In yet other embodiments, the stabilization component 18 may include a rectangular main body, a hollow tank extending from a face of the main body, and a removable cover. In this embodiment, the stabilization component 18 is operable to span the gap from the back wall 22 to the front wall 28 to secure the right side wall 24 or left side wall 26 in an extended position and thereby replacing the shelf member 32. Advantageously, the stabilization component 18 may be transported without water or sand to reduce the cost of shipping the privacy shelter 10.

Figures 4, 5:
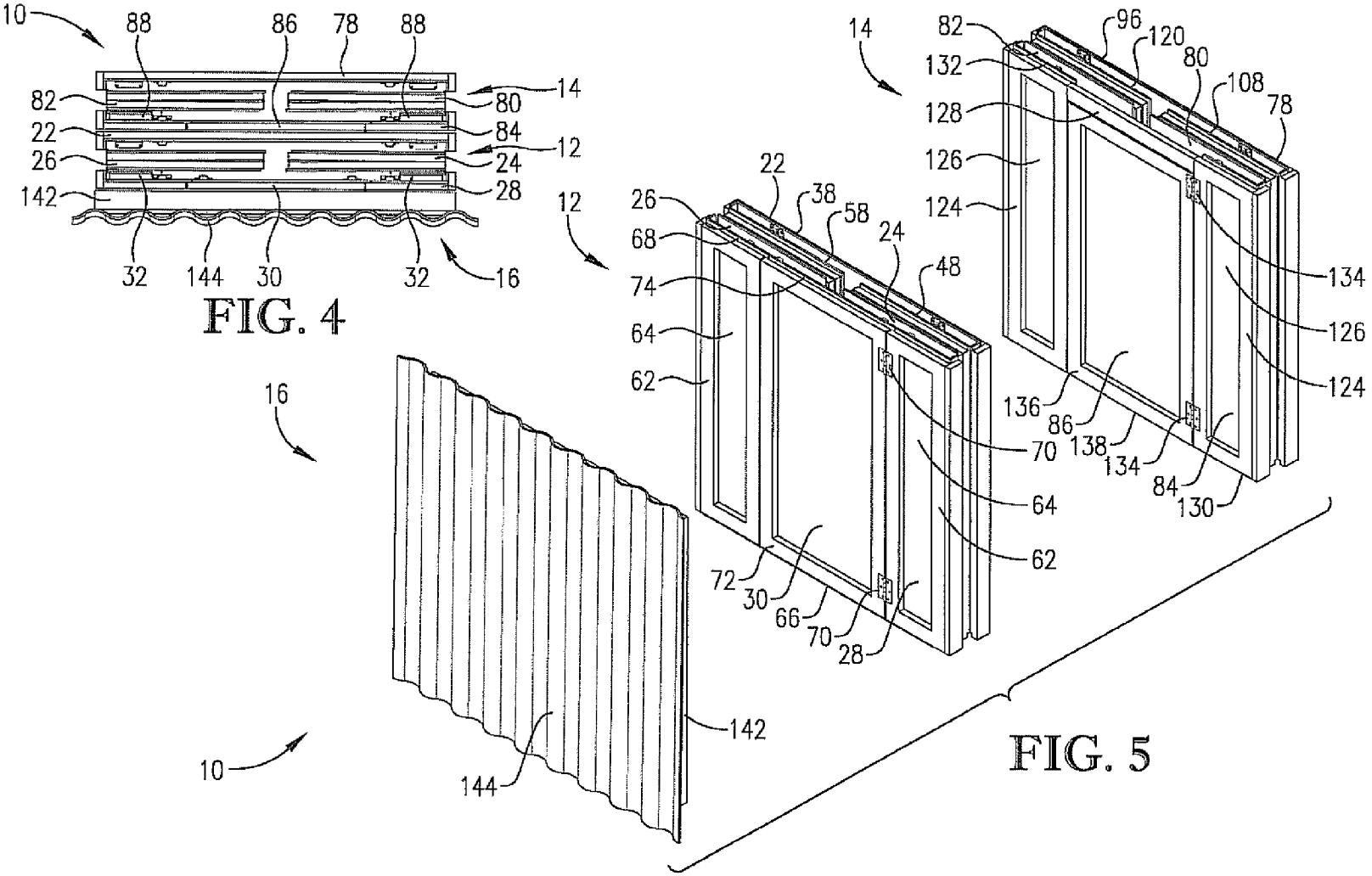
FIG. 4 is an elevational view of the privacy shelter collapsed for transport.
FIG. 5 is an isometric view of the roof section, collapsed upper section, and collapsed lower section.

FIGS. 4-11 illustrate use of the privacy shelter 10. The privacy shelter 10 is first transported to a location with the lower section 12, upper section 14, and roof section 16 collapsed. As shown in FIGS. 4 and 5, in some embodiments, the collapsed lower section 12, the collapsed upper section 14, and the roof section 16 are substantially the same length and width and may be stacked in a compact manner for transport in a trunk, truck bed, or the like.

Figure 6:
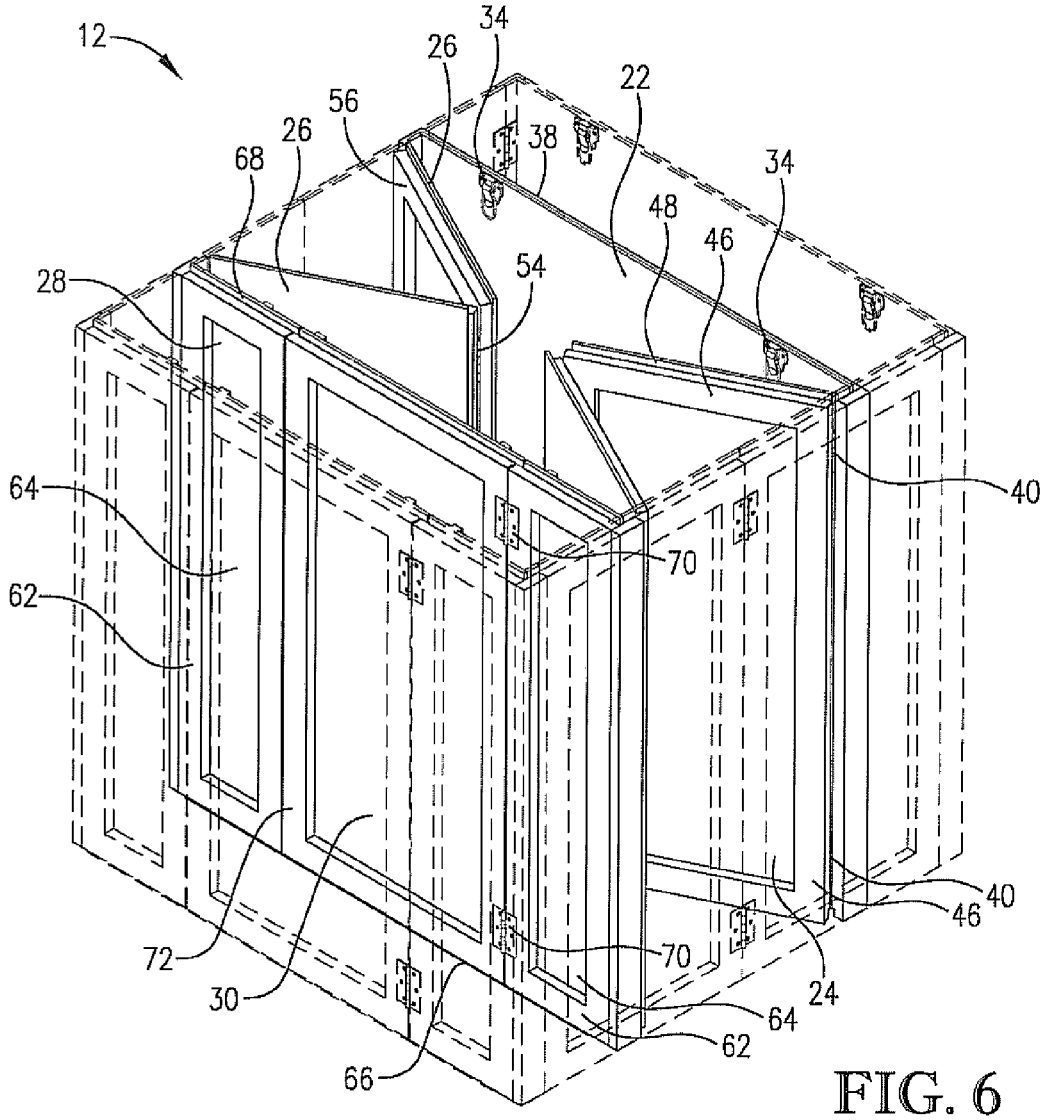
FIG. 6 is an isometric view depicting the extension and collapsing of the lower section.
Figure 7:
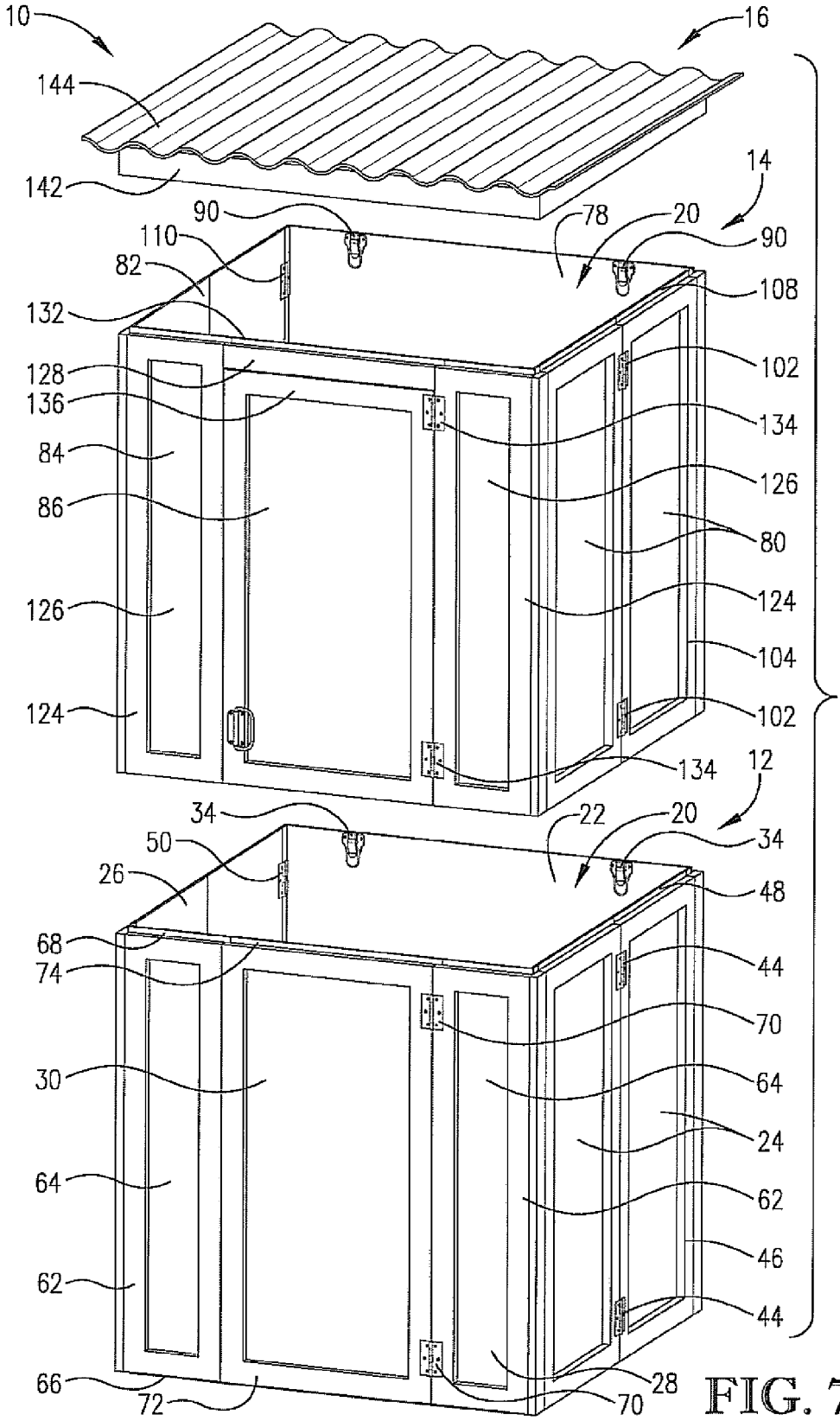
FIG. 7 is an isometric view of the lower section, the upper section, and the roof section showing the relative alignment of the three sections for assembly.

To assemble the privacy shelter 10, the collapsed lower section 12, the collapsed upper section 14, and the roof section 16 are separated, as shown in FIG. 5. The right and left side walls 24, 26 of the lower section 12 and right and left side walls 80, 82 of the upper section 14 are each extended so adjacent walls are at a generally perpendicular orientation, as shown in FIG. 6. As shown in FIG. 7, the upper section 14 is raised and placed upon the lower section 12 so the lower edge 152 of the upper section 14 engages the upper edge 154 of the lower section 12. The roof section 16 is similarly placed upon the upper section 14 so the lower edge 148 of the roof section 16 engages the upper edge 150 of the upper section 14.

Figure 8:
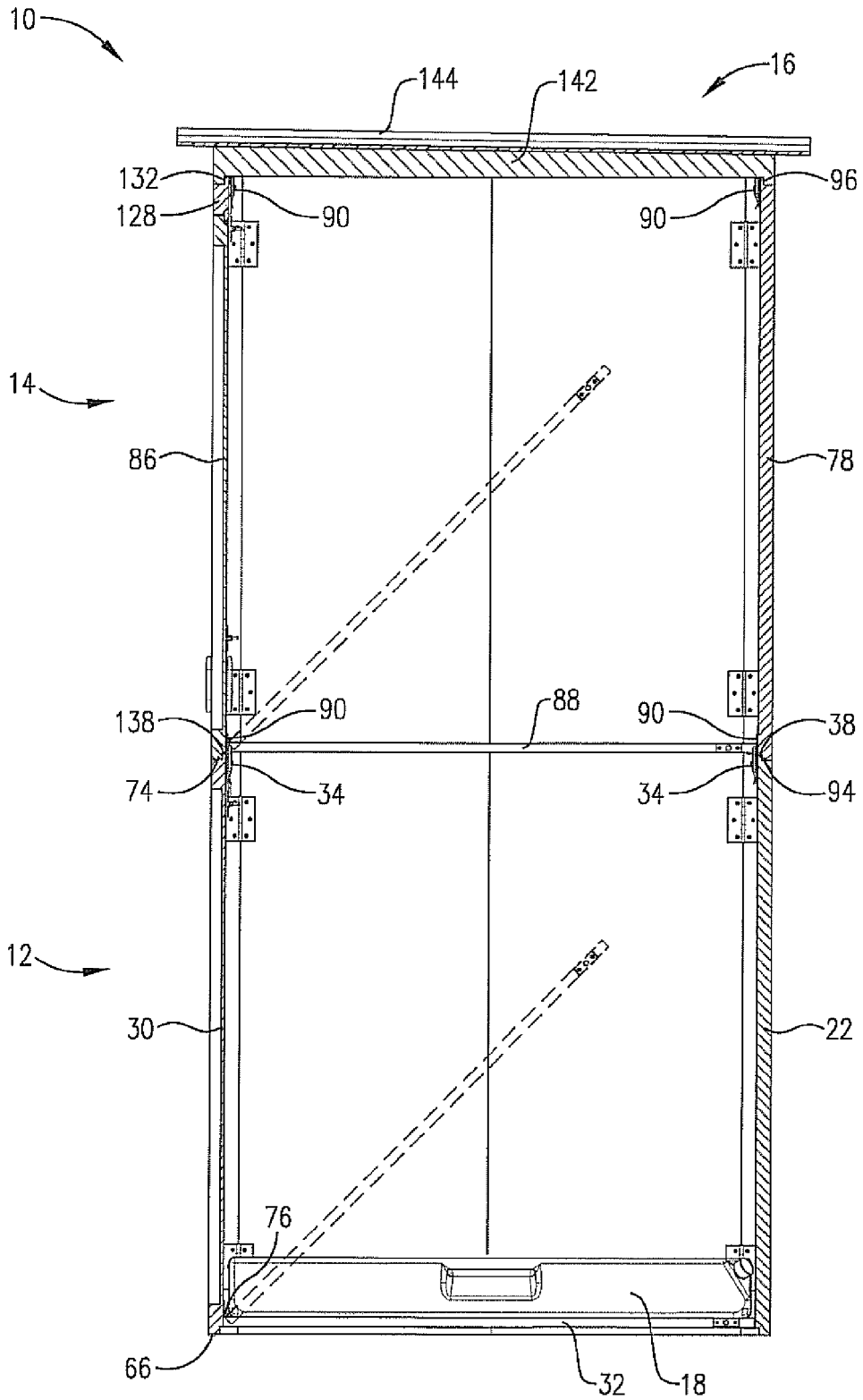
FIG. 8 is a vertical sectional view of the privacy shelter showing the shelf members partially and fully extended.
Figure 9:
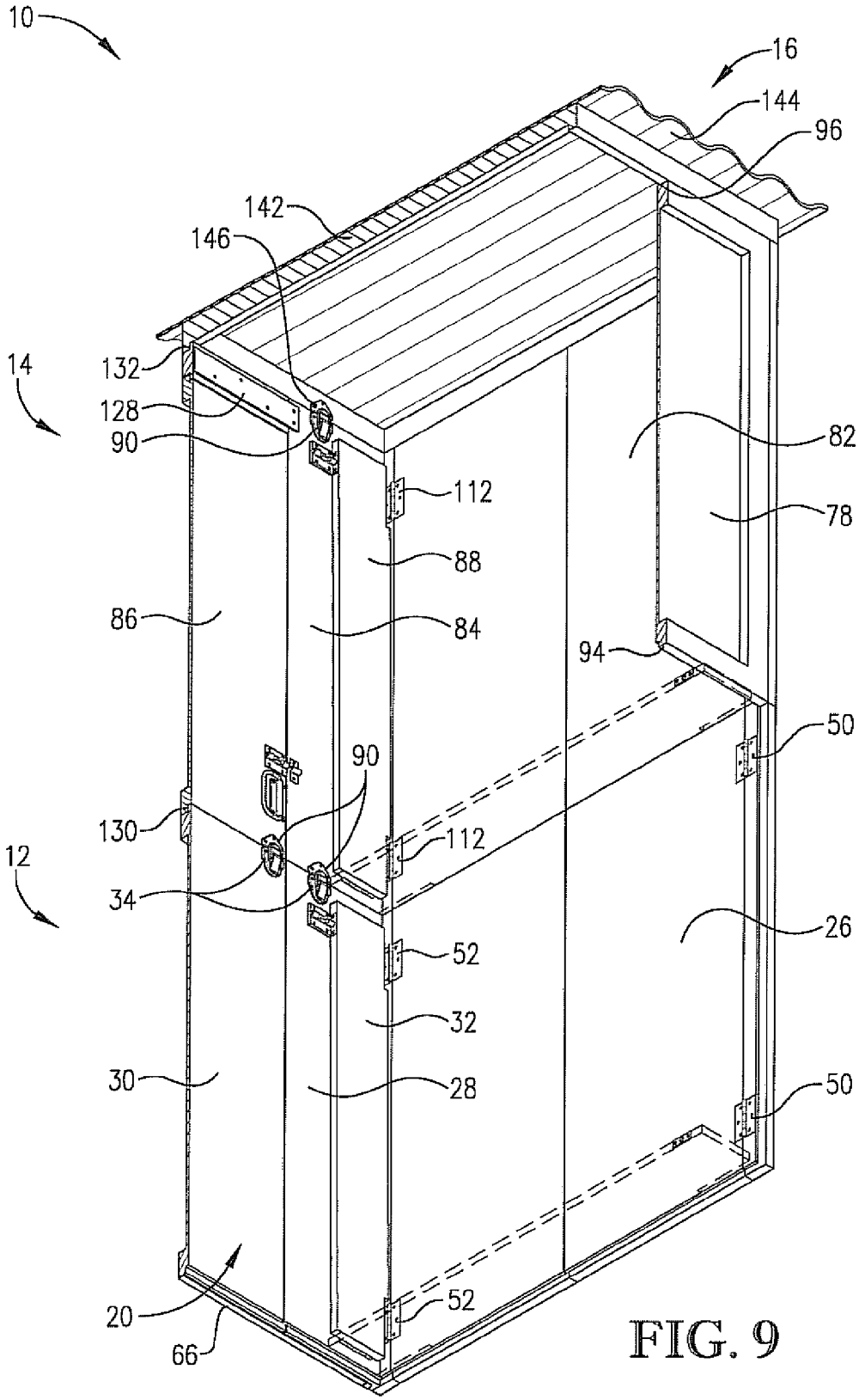
FIG. 9 is a vertical sectional isometric view showing the interior of the front, the side, and the top of the privacy shelter and showing the shelf members collapsed and extended.

Turning in particular to FIGS. 8-9, the shelf member 32 of the lower section 12 is pivotally extended from a position generally parallel to the front wall 28 of the lower section 12 to a position generally perpendicular to the front wall 28 of the lower section 12. When extended, a lateral edge of the shelf member 32 is disposed near to an interior face of the right or left side wall 24, 26 of the lower section 12 and, thus, prevents the left or right side wall 24, 26 from folding inward. In some embodiments, the distal edge of the shelf member 32 engages a flange or recess within the back wall 22 of the lower section 12 and, thus, is secured in position by the flange or recess and by the force of gravity acting on the shelf member 32. In some embodiments, the shelf member 32 may also be secured in position against the front wall 28 with a latch, hook, or other attachment mechanism. Some embodiments utilize two or more self members 32 to provide additional security and rigidity by securing both the right side wall 24 and the left side wall 26.

Similarly, the shelf member 88 of the upper section 14 is pivotally extended from a position generally parallel to the front wall 84 of the upper section 14 to a position generally perpendicular to the front wall 84 of the upper section 14. When extended, a lateral edge of the shelf member 88 is disposed near to an interior face of the right or left side wall 80, 82 of the upper section 14 and, thus, prevents the right or left side wall 80, 82 from folding inward. In some embodiments, the distal edge of the shelf member 88 engages a flange or recess within the back wall 78 of the upper section 14 and, thus, is secured in position by the flange or recess and by the force of gravity acting on the shelf member 88. In some embodiments, the shelf member 88 may also be secured in position against the back wall 78 with a latch, hook, or other attachment mechanism. Some embodiments utilize two or more self members 88 to provide additional security and rigidity.

Figure 10:
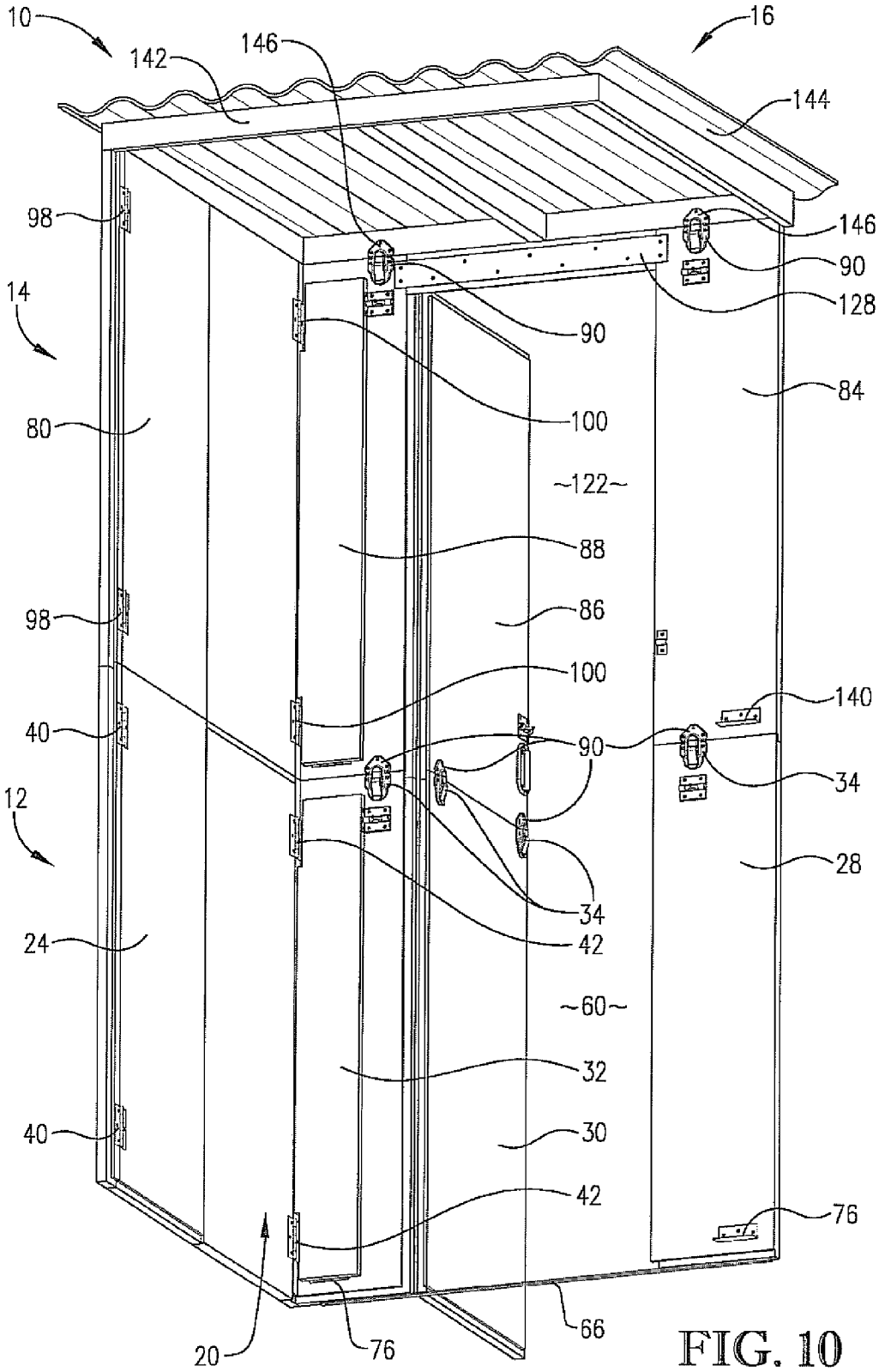
FIG. 10 is an isometric view with the back wall and one side wall removed to show the interior of the front, the side, and the top of the privacy shelter with the door open.
Figure 11:
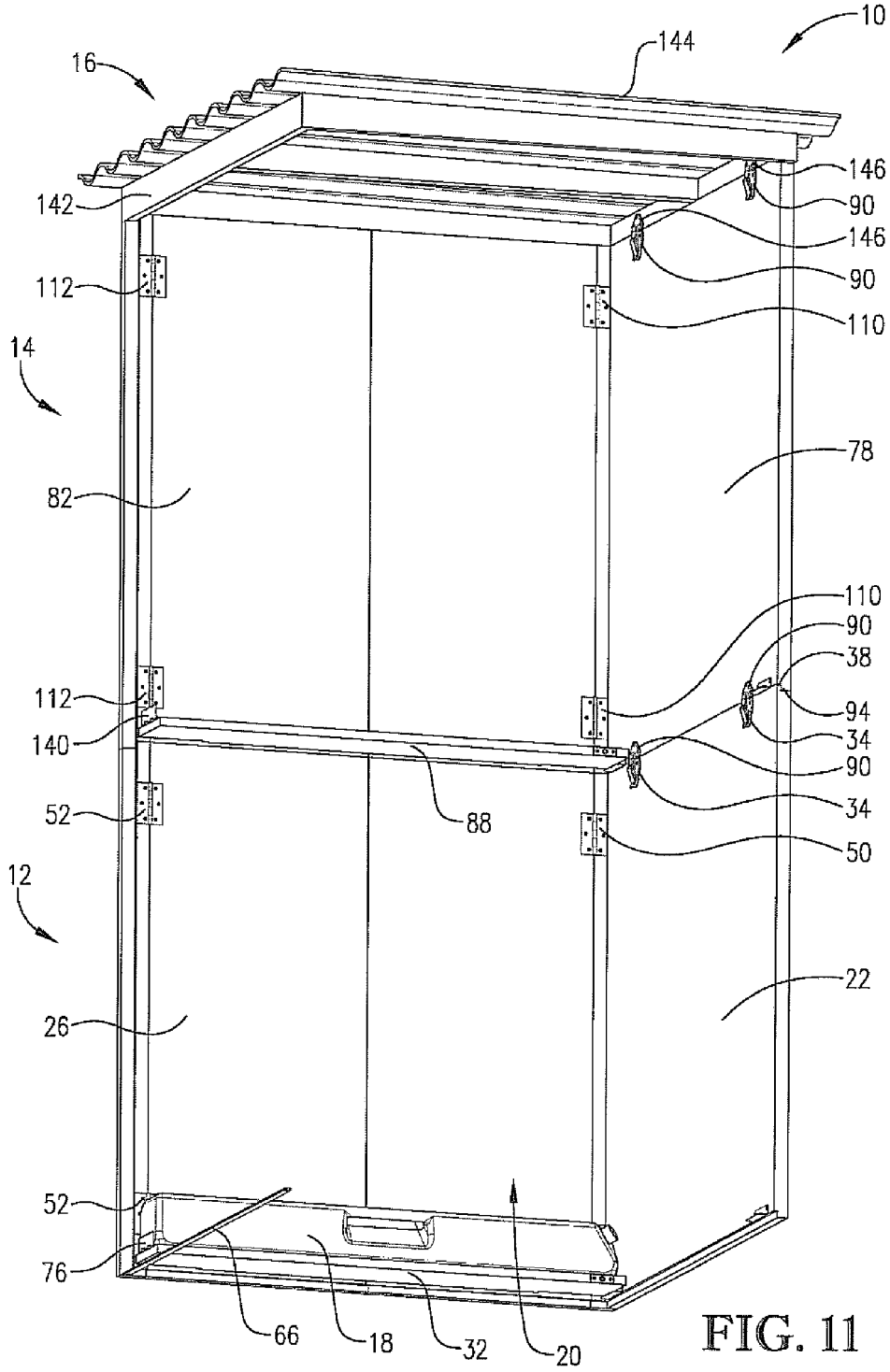
FIG. 11 is an isometric view with the front wall and one side wall removed to show the interior of the back, the side, and the top of the privacy shelter.
Figure 12:
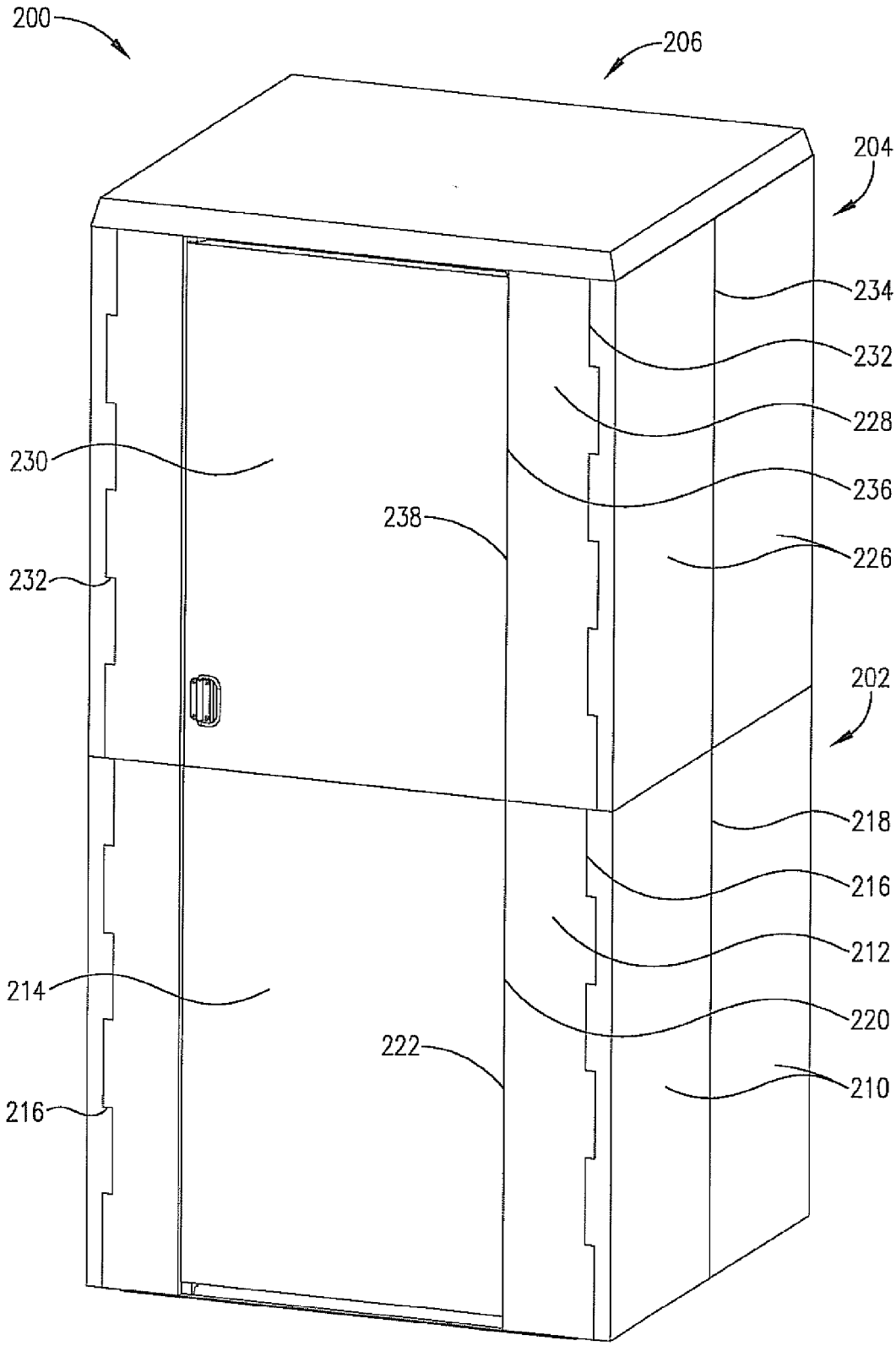
FIG. 12 is an isometric view of a privacy shelter constructed in accordance with another embodiment of the present invention.
Figure 13:
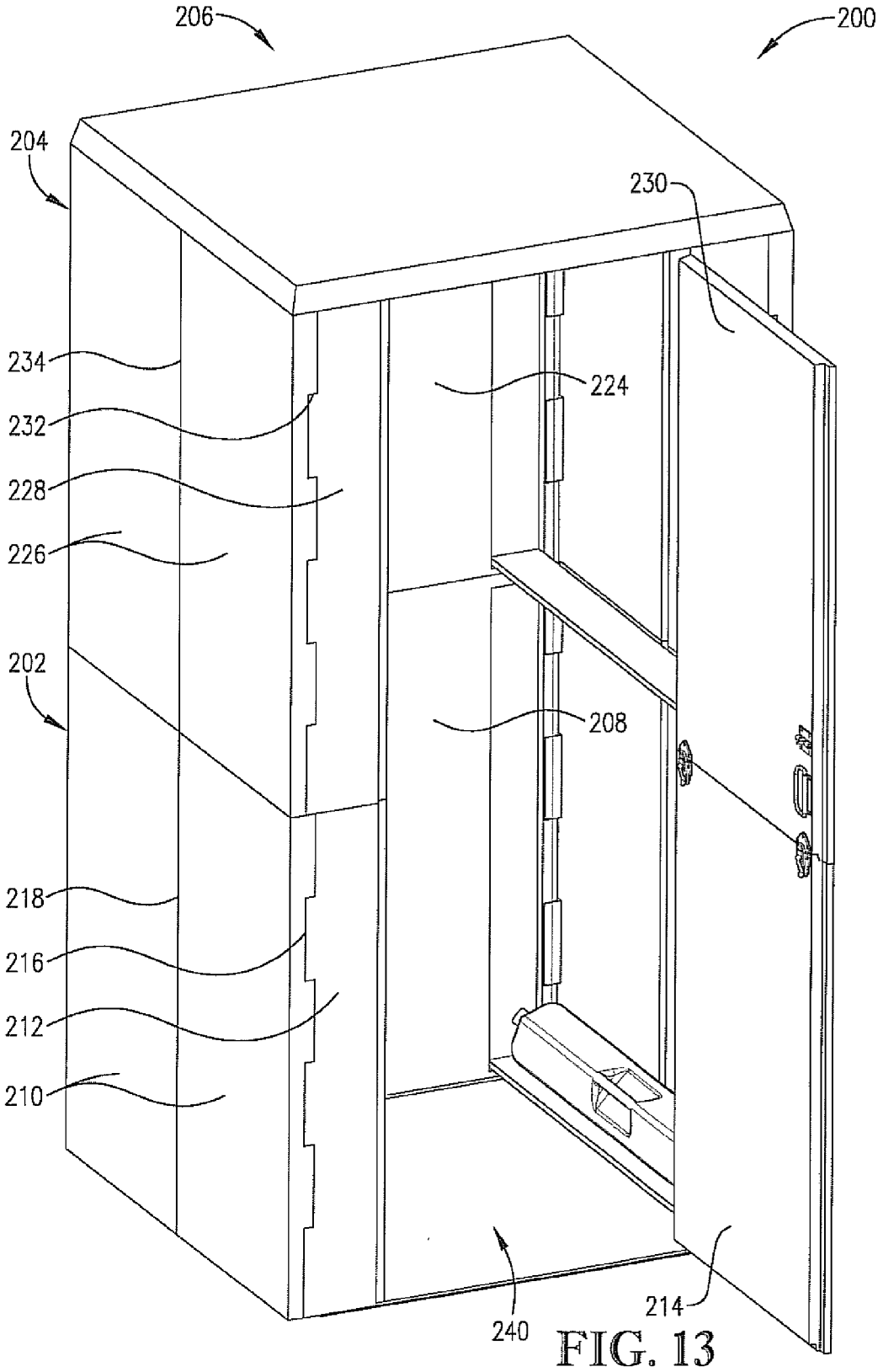
FIG. 13 is an isometric view of the privacy shelter of FIG. 12 with the door open partially showing the interior space.
Figure 14:
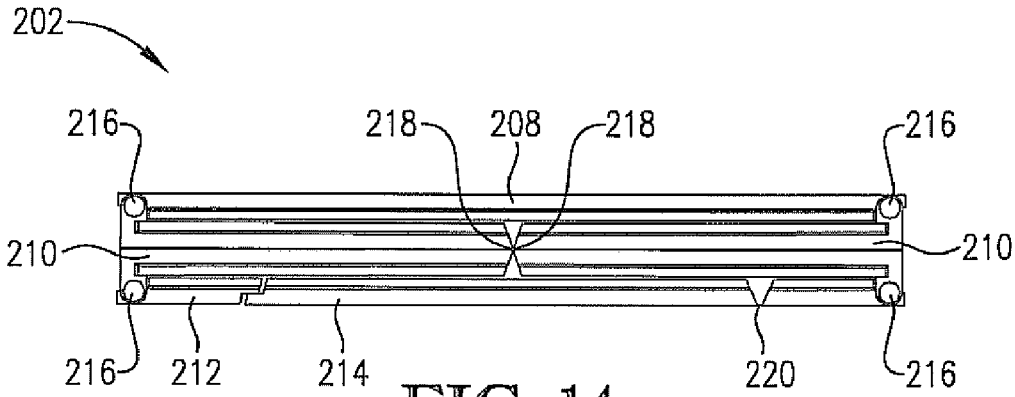
FIG. 14 is an elevational view of the collapsed lower section of the privacy shelter of FIG. 12.
Figure 15:
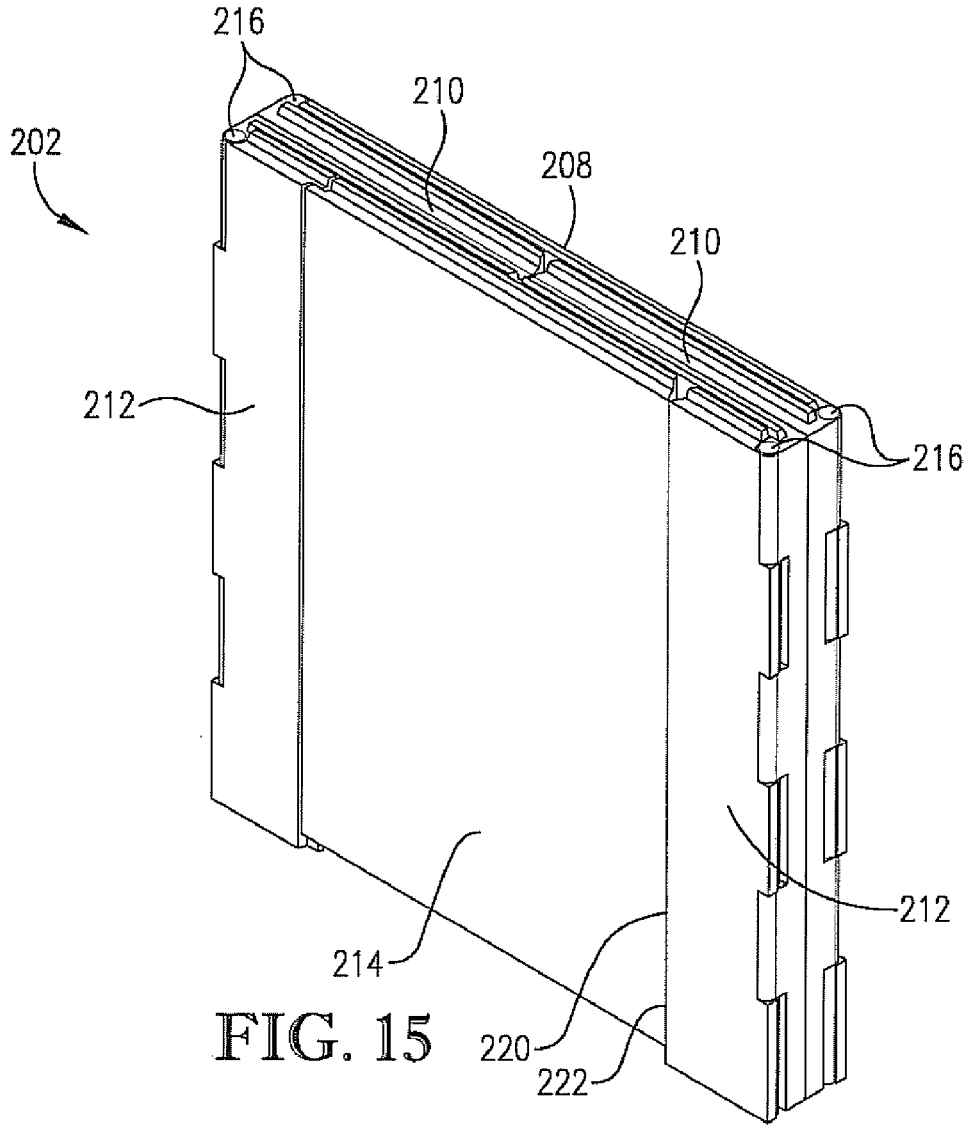
FIG. 15 is an isometric view of the collapsed lower section of the privacy shelter of FIG. 12.
Figure 16:
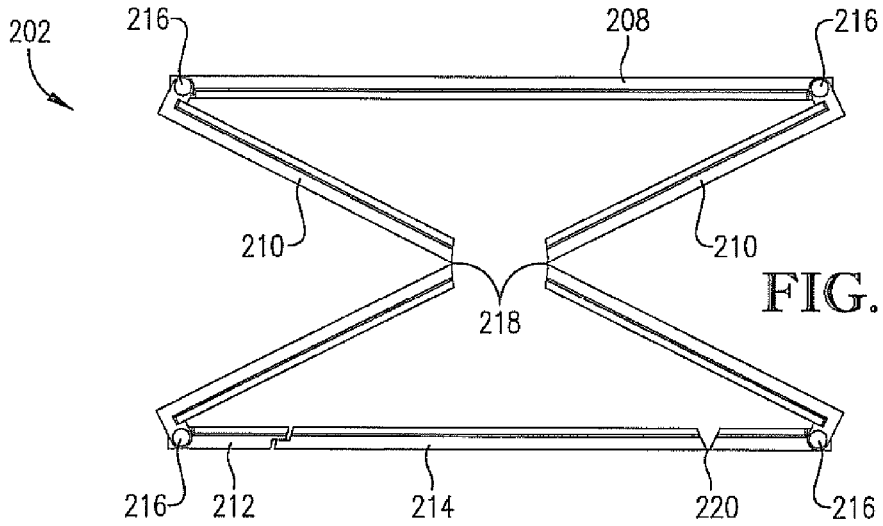
FIG. 16 is an elevation view of the partially collapsed lower section of the privacy shelter of FIG. 12.
Figure 17:
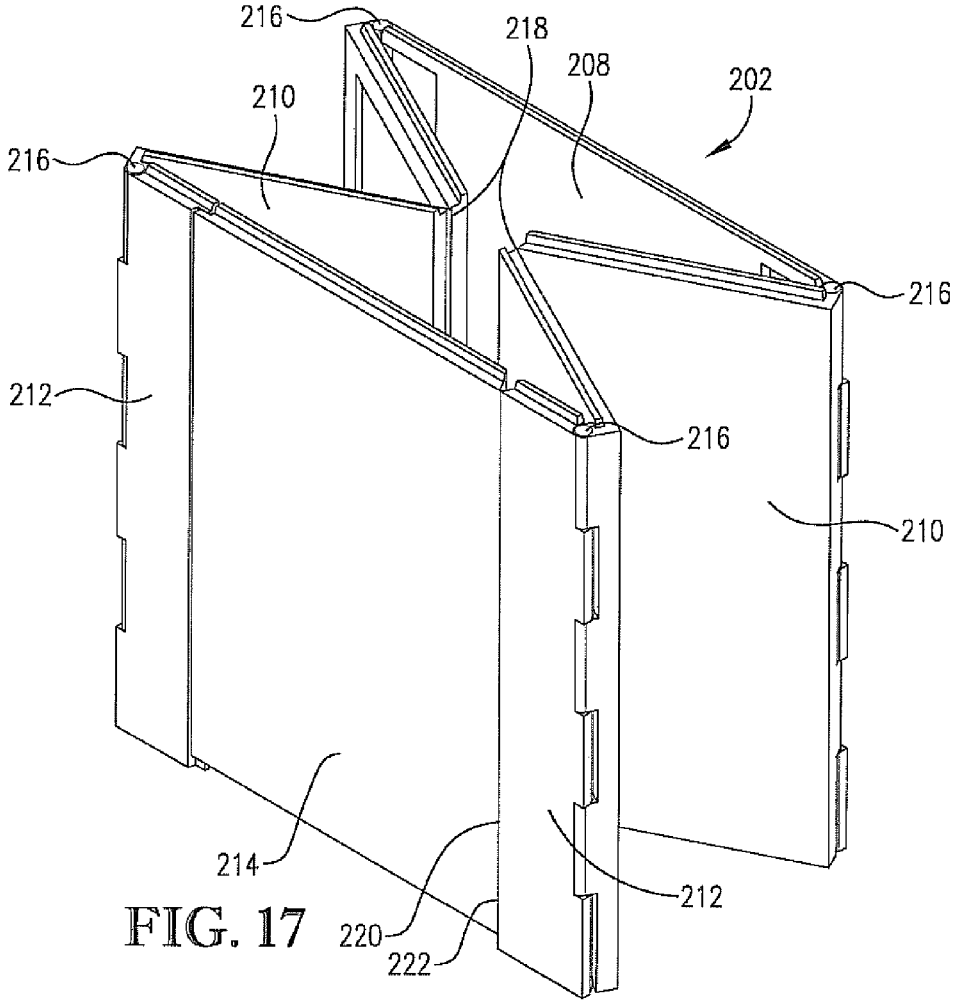
FIG. 17 is an isometric view of the partially collapsed lower section of the privacy shelter of FIG. 12.
Figure 18:
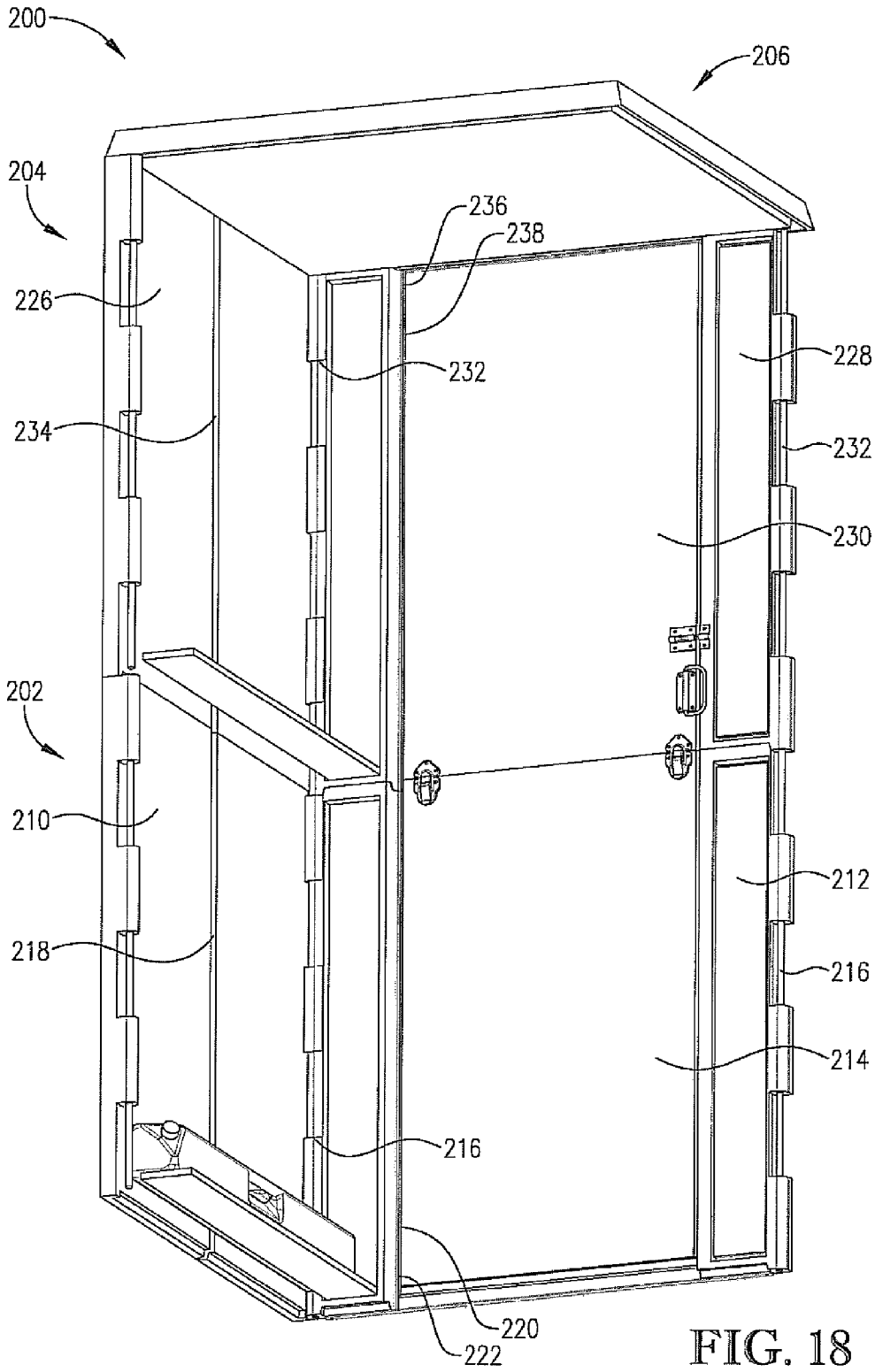
FIG. 18 is an isometric view with the back wall and one side wall removed to show the interior of the front, side and top of the privacy shelter of FIG. 12.
Figure 19:
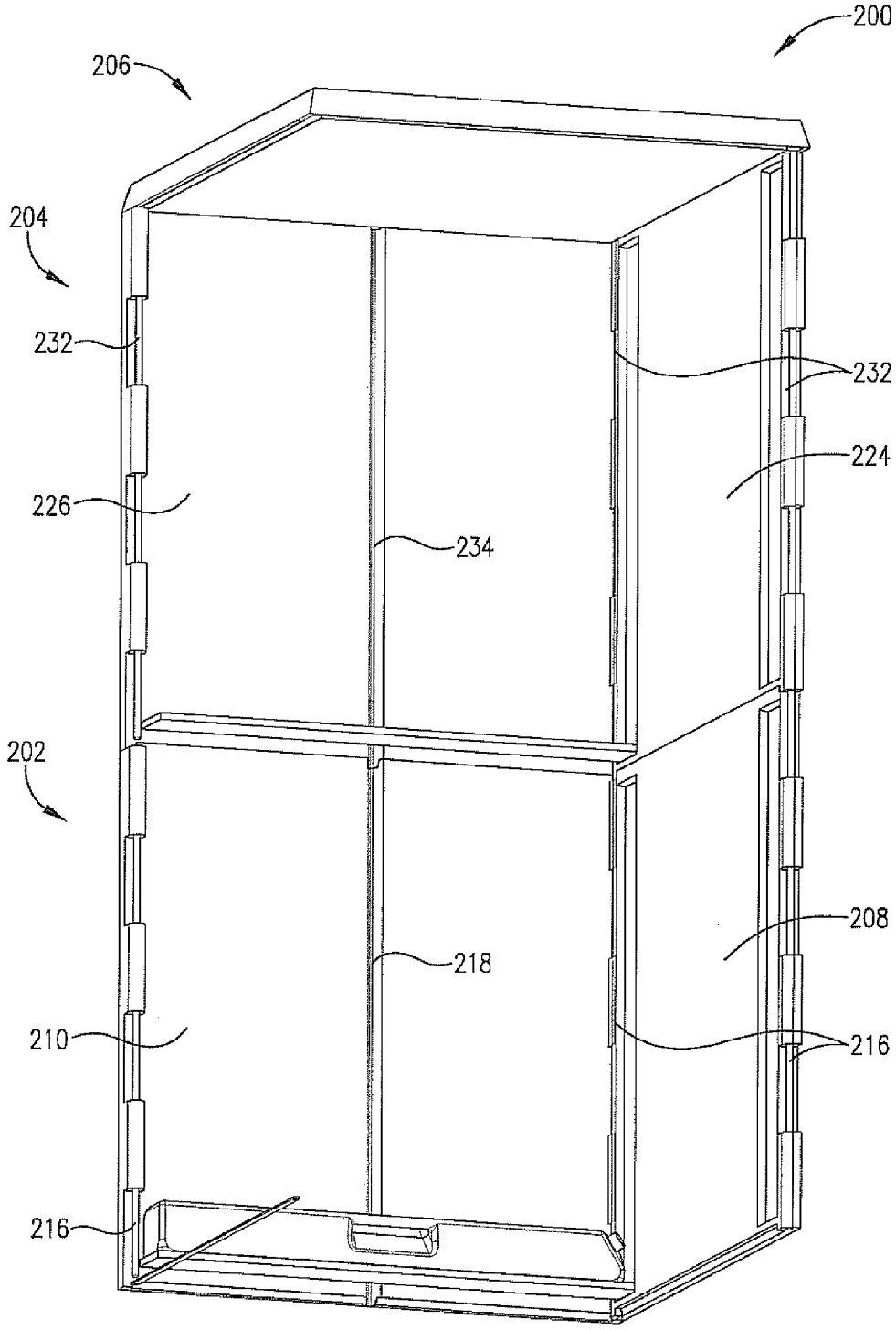
FIG. 19 is an isometric view with the front wall and one side wall removed to show the interior of the back, side and top of the privacy shelter of FIG. 12.

As best shown in FIGS. 9-11, the lower section 12 and the upper section 14 may be secured together by using a plurality of fastening mechanisms 34 disposed on the upper edge 154 of an interior face of the lower section 12 and a mating fastening mechanism 90 disposed on a lower edge 152 of an interior face of the upper section 14. The upper section 14 and roof section 16 may be secured together using a plurality of fastening mechanisms 90 disposed on the upper edge 150 of an interior face of the upper section 14 and a mating fastening mechanism 146 disposed on a lower edge 148 of an interior face of the roof section 16.

When secured, each wall 78, 80, 82, 84 of the upper section 14 is secured to the corresponding wall 22, 24, 26, 28 of the lower section 12 to form a unitary whole. Similarly, the door 86 of the upper section 14 is secured to the door 30 of the lower section 12 to form a unitary whole. Additionally, the roof section 16 is secured to an upper edge of the upper section 14 to form a unitary whole. Thus, when assembled, the lower section 12, upper section 14, and roof section 16 combine to form a sturdy structure. Users may choose to place a portable toilet within the interior space 20 of the privacy shelter 10.

When the user wants to move the privacy shelter 10, the privacy shelter 10 may be collapsed by performing the assembly steps in a generally reverse order.

Turning to FIGS. 12-19, another embodiment of a privacy shelter 200 is illustrated. This embodiment is substantially similar to the privacy shelter 10 of FIGS. 1-11, except where indicated. In this embodiment, the privacy shelter 200 broadly comprises a lower section 202, an upper section 204, and a roof section 206.

The lower section 202 includes a back wall 208, side walls 210, a front wall 212, and a door 214 that are each fabricated from plastic and utilize a continuous hinge 216 between adjacent walls 208, 210, 212. Additionally, each side wall 210 utilizes a living hinge 218 along a generally-vertical central axis so each side wall may fold inward, like an accordion, along the living hinge 218. This embodiment also uses a living hinge 220 along an edge 222 between the front wall 212 and the door 214.

The upper section 204 includes a back wall 224, side walls 226, a front wall 228, and a door 230 that are each fabricated from plastic and utilize a continuous hinge 232 between adjacent walls 224, 226, 228. Additionally, each side wall 226 utilizes a living hinge 234 along a generally-vertical central axis so each side wall may fold inward, like an accordion, along the living hinge 234. This embodiment also uses a living hinge 236 along an edge 238 between the front wall 228 and the door 230.

In this embodiment, the roof section 206 is a unitary rectangular cap for positioning on an upper edge of the upper section 204 that is fabricated from plastic and, in some embodiments, may be translucent to obscure the inner space 238 of the privacy shelter 200 while allowing exterior light to enter.

Figure 20:
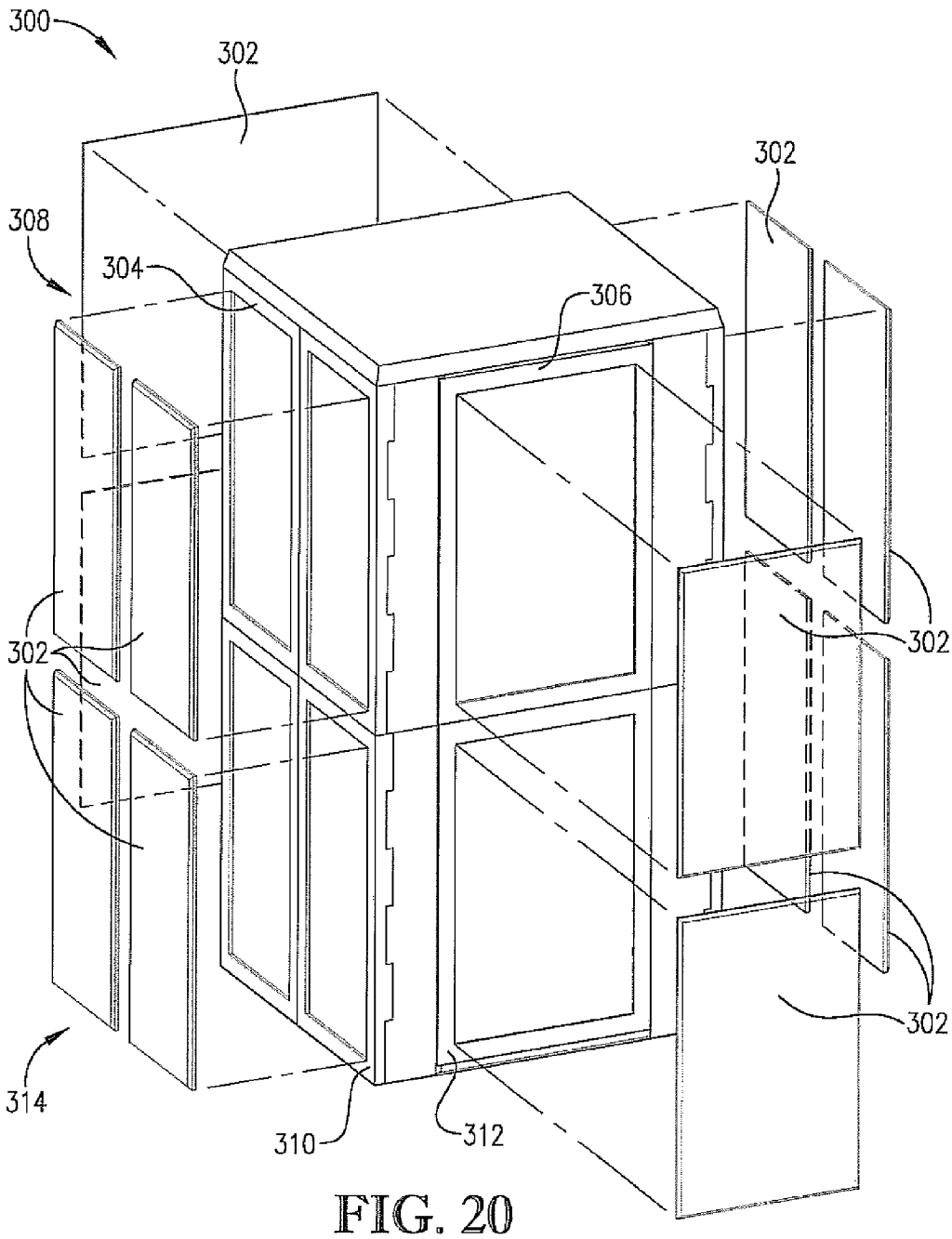
FIG. 20 is an isometric view of a privacy shelter with removable panels constructed in accordance with another embodiment of the present invention.

Turning to FIG. 20, another embodiment of a privacy shelter 300 is illustrated. This embodiment is substantially similar to the privacy shelter 200 of FIGS. 12-19, except as indicated. Though this embodiment is depicted with reference to the privacy shelter 300, the features of this embodiment may be used with other embodiments without deviating from the scope of the invention.

In this embodiment, the privacy shelter 300 further includes removable panels 302 disposed in the back wall (not shown), each side wall 304, and door 306 of other upper section 308 and disposed in the back wall (not shown), each side wall 310, and door 312 of the lower section 314. In some embodiments, the removable panels 302 may be removably secured with latches, screws, adhesive, or the like. In some embodiments, the removable panels 302 include logos, team emblems, mascots, advertising, or the like, on an inner, outer surface, or both.

In some embodiments, the removable panels 302 may further include an LCD, OLED, OLED, AMOLED, or the like, on an inner surface or outer surface of the removable panels 302, or both. Thus, the removable panels 302 may be operable to display advertisements, animated logos, or the like, inward or outward. Inward-facing displays may also provide a light source for a user when inside a closed privacy shelter 302.

The above described embodiments of a privacy shelter provide numerous advantages over prior art privacy shelters. For example, the privacy shelter may be easily transported and assembled while remaining sturdy in windy conditions. The privacy shelter provides enhanced privacy and cleanliness by providing space without windows where users may readily and quickly change clothes. Additionally, when used with a portable toilet, the privacy shelter provides convenient and truly portable restroom facilities.

Although the invention has been described with reference to the preferred embodiment illustrated in the attached drawing figures, it is noted that equivalents may be employed and substitutions made herein without departing from the scope of the invention as recited in the claims.

What is claimed is:

1. A collapsible privacy shelter comprising:

a lower section including— a generally-rigid back wall, a pair of generally-rigid opposing side walls pivotally connected to the back wall, the side walls operable to fold inward, a generally rigid front wall pivotally connected to the side walls, and a door pivotally connected to the front wall;

an upper section including— a generally rigid back wall that can be disposed on an edge of the back wall of the lower section and operable to engage the back wall of the lower section, a pair of generally rigid opposing side walls pivotally connected to the back wall of the upper section, the side walls operable to fold inward and each operable to engage a corresponding side wall of the lower section, a generally rigid front wall pivotally connected to the plurality of side walls of the upper section and operable to engage the front wall of the lower section, and a door pivotally connected to the upstanding front wall of the upper section and operable to engage the door of the lower section; and a unitary elongated brace for stabilizing the privacy shelter, wherein a first end of the brace is disposed along an inner surface of the back wall of at least one of the upper section and the lower section, a second end of the brace is disposed along an inner surface of the front wall of at least one of the upper section and the lower section, and an edge of the brace is disposed along an inner surface of at least one of the side walls of at least one of the upper section and the lower section, wherein the brace is pivotally attached to at least one of the walls of at least one of the upper section and the lower section, wherein the upper and lower sections are shiftable between a first collapsed configuration and a second expanded configuration, wherein the brace is configured to prevent at least one of the side walls of at least one of the upper section and the lower section from folding inward in the second expanded configuration and is operable to pivot into a position that allows at least one of the side walls of at least one of the upper section and the lower section to fold inward to be placed into the first collapsed configuration.

2. The collapsible privacy shelter of claim 1, further comprising a roof section including a roof operable to engage an upper portion of the upper section.

3. The collapsible privacy shelter of claim 2, wherein the roof is at least one of:

translucent, allowing light into the privacy shelter in the second expanded configuration;

slanted at a non-perpendicular angle relative to the walls of the upper section; and formed of corrugated plastic.

4. The collapsible privacy shelter of claim 1, further comprising:

a securing device disposed on an upper edge of the lower section;

a securing device disposed along a lower edge of the upper section operable to removably engage the securing device of the lower section;

a securing device disposed on an upper edge of the upper section; and a securing device disposed along a lower edge of the roof section operable to removably engage the securing device on the upper edge of the upper section.

5. The collapsible privacy shelter of claim 4, wherein each of the securing devices comprises a latch or pin.

6. The collapsible privacy shelter of claim 1, further comprising: a weighted stabilization component configured to extend between the front wall and the back wall of the lower section to at least one of a right side and left side of the door of the lower section.

7. The collapsible privacy shelter of claim 1, further comprising a hollow stabilization component having a removable cover and configured to weigh the privacy shelter down when at least partially filled with a liquid or granular substance.

8. The collapsible privacy shelter of claim 1, further comprising a removable panel disposed within an opening in the back wall of the upper section, an opening in the side walls of the upper section, an opening in the front wall of the upper section, an opening in the door of the upper section, an opening in the back wall of the lower section, an opening in the side walls of the lower section, an opening in the front wall of the lower section, or an opening in the door of the lower section.

9. The collapsible privacy shelter of claim 8, wherein the removable panel includes a logo or a mascot.

10. The collapsible privacy shelter of claim 8, wherein the removable panel includes an LCD display or OLED display.

11. The collapsible privacy shelter of claim 1, wherein the side walls of the upper section and the side walls of the lower section each fold inward along a living hinge, a barrel hinge, a pivot hinge, a continuous hinge, or a concealed hinge.

12. The collapsible privacy shelter of claim 1, wherein the upper section and lower section are fabricated primarily from plastic, metal, or wood.

13. The collapsible privacy shelter of claim 1, further comprising a portable toilet configured to be positioned within at least one of the upper and lower sections.

* * * * *